US008066140B1

(12) United States Patent
Young et al.

(10) Patent No.: US 8,066,140 B1
(45) Date of Patent: Nov. 29, 2011

(54) CONTAINER DOOR AND CONTAINER DOOR LATCHING AND SEALING SYSTEM

(75) Inventors: Kendall Clark Young, Perry, OK (US); Gregory L. Stone, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 10/377,411

(22) Filed: Feb. 28, 2003

(51) Int. Cl.
*B65D 43/26* (2006.01)
*B65D 45/16* (2006.01)
*E05B 65/10* (2006.01)
*E05D 13/00* (2006.01)

(52) U.S. Cl. ..... 220/263; 220/324; 49/349; 292/256.5

(58) Field of Classification Search ..... 220/262–264, 220/324, 211; 70/208, 223; 49/279, 280, 49/394, 390, 348, 349; 292/123, 122, 97, 292/2, 299, 256.5, 201
See application file for complete search history.

(56) References Cited

U.S. PATENT DOCUMENTS

| | | | | | |
|---|---|---|---|---|---|
| 3,416,945 | A | * | 12/1968 | Zweidler et al. | 442/130 |
| 3,713,472 | A | * | 1/1973 | Dozois | 160/189 |
| 3,768,203 | A | * | 10/1973 | Bellucci | 49/254 |
| 3,888,528 | A | * | 6/1975 | Jericijo | 292/256.5 |
| 4,155,586 | A | | 5/1979 | Flynn | 296/56 |
| 4,222,404 | A | | 9/1980 | Flynn | 137/205 |
| 4,307,541 | A | | 12/1981 | Farmer et al. | 49/280 |
| 4,322,868 | A | | 4/1982 | Wurster | 15/302 |
| 4,510,714 | A | * | 4/1985 | Kasper et al. | 49/249 |
| 4,927,996 | A | * | 5/1990 | Genbauffe et al. | 219/413 |
| 5,016,717 | A | | 5/1991 | Simons et al. | 175/66 |
| 5,021,156 | A | | 6/1991 | Sloan | 210/241 |
| 5,141,528 | A | | 8/1992 | Boczkiewicz et al. | 55/1 |
| 5,287,602 | A | | 2/1994 | Dykstra | 24/463 |
| 5,596,788 | A | | 1/1997 | Linville et al. | 15/352 |
| 5,791,073 | A | | 8/1998 | Palmer et al. | 37/317 |
| 6,055,775 | A | * | 5/2000 | Dering et al. | 49/340 |
| 6,385,867 | B1 | | 5/2002 | Slabach et al. | 37/304 |
| 6,386,598 | B1 | | 5/2002 | Dykstra et al. | 292/113 |
| 6,391,258 | B1 | * | 5/2002 | Peake et al. | 422/26 |
| 6,470,605 | B1 | | 10/2002 | Gilman et al. | 37/323 |
| 2004/0108317 | A1 | * | 6/2004 | Buckner | 220/263 |

OTHER PUBLICATIONS

"Supersucker" Super Products Worldwide Vacuum Technology brochure, Copyright 1994, Milwaukee, WI.
"High Dump", Presvac Systerns Burlington, Limited brochure, Feb. 1998, Ontario, Canada.
"Introducing 60 Series Vacuum Excavation Systems" Vector Technologies Ltd. brochure, Copyrighted 2001, Milwaukee, WI. "Vac-Tron Equipment PMD Series" Vac-Tron Equipment brochure.
"FX30 Vacuum Excavation System"Ditch Witch Brochure.
"vaXcatator—The Green Machine" Vacuum Source Inc., Catalog 100/700, Greer, SC.
"E550 Vacuum Excavation System" Vermeer Manufacturing Company brochure, Pella, Iowa.

* cited by examiner

*Primary Examiner* — Robin Hylton
(74) *Attorney, Agent, or Firm* — Tomlinson Rust McKinstry Grable

(57) ABSTRACT

A door sealing system is used to seal a container of a vacuum system. In a preferred embodiment the vacuum system has a container door supported on a frame and adapted to seal the container when the container door is closed. A latch assembly supported on the container door is used to latch the container door to the container along a load bearing axis. A power operated pulling assembly located within the container forces the container door against the container by applying a load on the door that is collinear with the load bearing axis of the latch assembly. The power operated pulling assembly seals the container door to the container. The mechanical locking assembly is adapted to maintain the door in a sealed configuration after the power operated pulling assembly has sealed the container.

39 Claims, 5 Drawing Sheets

CONTAINER DOOR AND CONTAINER DOOR LATCHING AND SEALING SYSTEM

FIELD OF THE INVENTION

This invention relates generally to the field of solid sealed containers, and in particular to a method and apparatus for sealing a collection container in a vacuum system.

SUMMARY OF THE INVENTION

The present invention is directed to a door sealing system for a container having a container door. The sealing system comprises a latching assembly and a power operated pulling assembly. The latching assembly is supported on the container door and adapted to engage the container door with the container along a load bearing axis. The power operated pulling assembly is supported within the container and adapted to force the container door against the container by applying a load that is collinear with the load bearing axis of the latching assembly to seal the container door to the container.

The present invention further comprises a vacuum system. The vacuum system comprises a frame, a container having a container door, and a container door sealing system. The container is supported on the frame. The container door sealing system comprises a latching assembly and a power operated pulling assembly. The latching assembly is supported on the container door and adapted to engage the container door with the container along a load bearing axis. The power operated pulling assembly is supported within the container and adapted to force the container door against the container by applying a load that is collinear with the load bearing axis of the latching assembly to seal the container door to the container.

Still yet, the present invention comprises a method for sealing a container door of a container. The method comprises latching the container door to the container from inside the container and power sealing the container door to the container by applying a load to the container and the container door from within the container

BRIEF DESCRIPTION OF THE DRAWINGS

FIG. 3 shows the latching assembly engaged with a connecting rod so that the container door is engaging the container along a load bearing axis.

In FIG. 3 the power operated pulling assembly has been activated to force the container door toward the container to seal the container.

In FIG. 5 a locking assembly is shown mechanically locking the container door to the container after the action of the power operated pulling assembly has been completed.

DESCRIPTION OF THE PREFERRED EMBODIMENT

Figure 1:
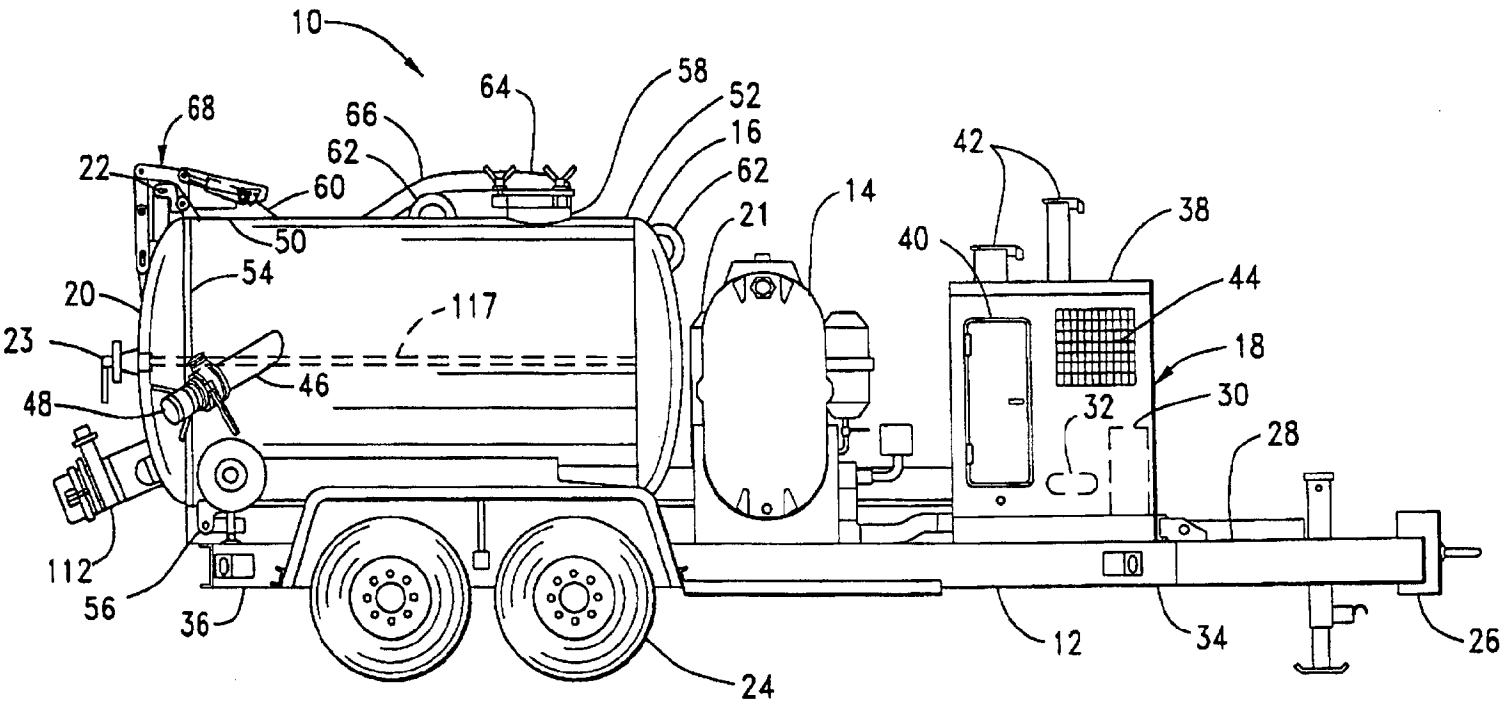
FIG. 1 is a side elevational view of a vacuum system supported on a trailer. The vacuum system has a container having a container door supported on the trailer. The container door has a door sealing assembly shown supported on the container door to seal the door to the container. Additionally, the vacuum system is shown equipped with a door lifting assembly and door lock system to move the door.

Turning now to the figures and first to FIG. 1, the environment in which the apparatus and method of the present invention is used is illustrated. FIG. 1 shows a vacuum system generally indicated by the numeral 10 supported on a trailer 12. The vacuum system 10 comprises a water tank 14, a container 16, an engine assembly 18, a container door 20, a filter assembly 21, and a frame 22. The container door 20 is pivotally supported on the container by the frame 22. The structure and function of the frame 22 will be discussed further with regard to FIG. 2. In FIG. 1, the container door 20 supports a centrally located door sealing system 23 adapted to engage the container door 20 with the container 16. The door sealing system 23 is further adapted to power seal the container door 20 to the container 16 after the door has engaged the container so that an operator is not required to pull a vacuum to hermetically seal the container. Thus, the door sealing system 23 provides a method and apparatus for maintaining a hermetically sealed container without the need for a vacuum within the container. While the door sealing system 23 will be described with reference to the vacuum system 10, it will be appreciated that the door sealing system of the present invention may by used in various other applications that require the sealing of a container.

The trailer 12 has wheels 24 and a tow bar 26 for towing the trailer behind a vehicle. The trailer 12 may further comprise a platform 28, on which the engine assembly 18, water tank 14, container 16, a water pump 30, and vacuum pump 32 are carried. The engine assembly 18 is supported on the front end 34 of the trailer 12 and the container 16 is carried on the rear end 36 of the trailer. The water tank 14 and other components and accessories are carried on the trailer 12 with the container 16 and the engine assembly 18. However, it will be appreciated that the above-described components may be supported in differing arrangement on a fixed platform or on a different type vehicle such as a motor vehicle.

The engine assembly 18 may comprise a diesel engine (not shown) supported within an engine compartment 38. It will be appreciated, of course, that different type engines or power sources may be used to power the vacuum system 10. The engine compartment 38 has control panel 40, exhaust pipes 42, and vents 44. An access door (not shown) allows easy access to the inside of the engine compartment 38 and to the engine. The engine assembly 18 is adapted to drive operation of the door sealing system 23, water pump 30, the vacuum pump 32, and various other hydraulic and electrical systems used with the vacuum system 10.

As previously discussed the engine assembly 18 is adapted to drive operation of the vacuum pump 32. The vacuum pump 32 operates to produce a vacuum in the closed container 16. The vacuum created within the container 16 draws a vacuum through the inlet 46 of the container. The inlet 46 of the container 16 is shown closed by a plug 48. However, it will be appreciated that a hose and reduction tool (not shown) may be connected to the inlet 46 for use by the operator to collect solids or liquids into the container 16.

Continuing with FIG. 1, the container 16 and the systems and methods for sealing the container door 20 to the container will be discussed in more detail. The container 16 is generally cylindrical, having a first end 50 and a second end 52. The inlet 46 is disposed on a side of the container 16 and near the first end 50 of the container. The first end 50 of the container 16 is generally open and comprises a rim 54 adapted to mate with the container door 20 when the container door is engaged with the container 16. A rubber seal (not shown) is generally disposed within the rim 54 and around the circumference of the rim to hermetically seal the container when the door sealing assembly 23 has sealed the container. The second end 52 of the container 16 is generally sealed and is not openable. It will, however, be appreciated that the second end 52 of the container 16 may support a second container door (not shown) thus allowing for access to the inside of the second end 52 of the container.

Referring still to FIG. 1, the container 16 is connected to the trailer 12 using a mounting bracket 56. The mounting bracket 56 is supported on the bottom side and toward the first end 50 of the container 16. The mounting bracket 56 is adapted to pivotally connect the container 16 to the trailer 12 so that container 16 may be pivoted upward to allow for dumping of the contents contained therein. A hydraulic lifting assembly (not shown) may be disposed under the container 16 and adapted to tilt the second end 52 of the container upward to facilitate dumping of the contents.

The top of the container 16 supports a shut-off valve 58, the door lifting assembly 68, and the frame 22. The shut-off valve 58 is supported toward the second end 52 of the container 16 and connected to the filter assembly 21 by hose 66 and subsequently to the vacuum pump 32. The filter assembly 21 is adapted to prevent dirt or other matter from entering the vacuum pump 32 during operation of the vacuum system 10 by filtering such matter from the air entering the vacuum pump 32.

Figure 2:
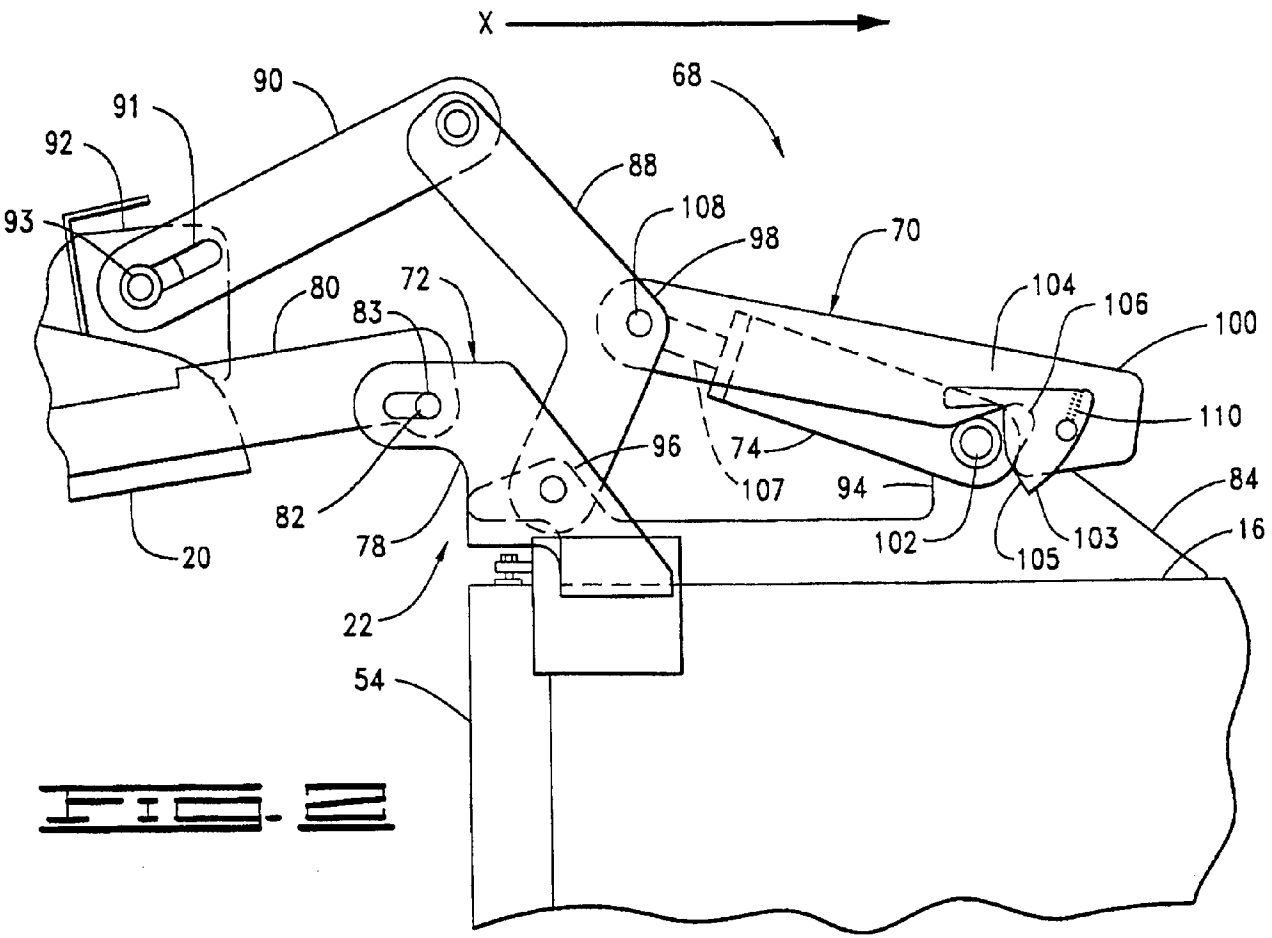
FIG. 2 is a side elevational view of the container door lifting assembly and door lock system shown in FIG. 1. The door lifting assembly and lock system shown in FIG. 2 are adapted to move the container door to an open position and lock the door in the open position.

Turning to FIG. 2, there is shown therein the frame 22, supporting the container door 20, and the lifting assembly 68 all supported on the container 16 at the first end 50. As previously discussed, the frame 22 pivotally supports the container door 20 on the container 16 so that action of the lifting assembly 68 can move the door between the closed position shown in FIG. 1 and the open position in FIG. 2. The lifting assembly 68 is supported by the container 16 and connected to the container door 20 using a mechanical linkage system. The lifting assembly 68 of FIG. 2 comprises a lock assembly 70 adapted to secure the container door 20 in the open position. The lifting assembly 68 comprises a door hinge assembly 72, a hydraulic cylinder 74, and a cylinder lock 100.

The frame 22 comprises a container mounted bracket 78 and a door mounted bracket 80. The container mounted bracket 78 and the door mounted bracket 80 pivotally support the container door 20 on the container 16 using a pin 82. The container mounted bracket 78 is formed of a resilient material capable of bearing the load of the container door 20. The container mounted bracket 78 has an eyelet 83 adapted to support the pin 82. The door mounted bracket 80 is connected to the container door 20 and comprises an eyelet similar to eyelet 83 to receive pin 82. The door mounted bracket 80 and container mounted bracket 78 are formed to allow pivotal movement of the door in response to operation of the lifting assembly 68.

The lifting assembly 68 as shown in FIG. 2 facilitates hydraulic raising and lowering of the container door 20. The hydraulic lifting assembly 68 comprises a base bracket 84, the hydraulic cylinder 74, an intermediate link 88, a final link 90, and a final link bracket 92. The base bracket 84 is supported on the container 16 and is generally elongate. The base bracket 84 comprises a first tab 94 to pivotally support the hydraulic cylinder 74 and a second tab 96 adapted to pivotally connect the base bracket 84 to the intermediate link 88. The first tab 94 is constructed to support the base of the hydraulic cylinder 74 using a pin 102.

The intermediate link 88 may be generally L-shaped for connection to the final link 90 and the second tab 96. Thus, the intermediate link 88 has an elbow 98. The elbow 98 is adapted for connection with the hydraulic cylinder 74 and the cylinder lock 100. The final link 90 is pivotally connected to the second end of the intermediate link 88 at one end and the final link bracket 92 at the other end. The final link 90 has an elongate eyelet 91 for receiving a pin 93 and connecting the final link to the final link bracket 92. The final link bracket 92 is supported on the container door 20 in a manner so that the bracket is capable of withstanding the forces exerted upon the bracket while the container door 20 is pivotally moved.

In operation, the hydraulic cylinder 74 is at a starting position when the cylinder is extended and the container door 20 is closed. The hydraulic cylinder 74 is connected to the base bracket 84 at one end and the elbow 98 of the intermediate link 88 at the other end. As shown in FIG. 2, when the hydraulic cylinder 74 has been pressurized using hydraulic fluid to retract the cylinder rod 107, the intermediate link 88 is pivoted in direction X. Pivoting the intermediate link 88 in direction X causes the intermediate link to pull the final link 90 and moves the container door 20 to an open position.

Operation of the hydraulic lifting assembly 68 to lift the container door 20, as described above, causes the lock assembly 70 to operate. As the intermediate link 88 is pivoted in direction X, the cylinder lock 100 slides over pin 102 until the cylinder lock falls onto the pin 102. The cylinder lock 100 is generally elongate and comprises a notch 106 near one end of the lock and an eyelet 108 near the other end. Eyelet 108 is adapted to connect the cylinder lock 100 to the elbow 98 of the intermediate link 88. The notch 106 is adapted to latch onto the pin 102 when the cylinder lock 100 is moved in direction X and is pivoted downward. Once the notch 106 is latched onto the pin 102, the door 20 is locked in the open position. A torsion spring (not shown) may be positioned around the pin 108, at the connection between the cylinder lock 100 and the intermediate link 88, to forcibly pivot the cylinder lock downward over the pin 102. However, it will be appreciated that the use of a torsion spring is not required as the cylinder lock 100 is adapted to latch onto the pin 102 under the force of gravity.

When the cylinder lock 100 is latched on the pin 102, the cylinder lock bracket 104 is pivoted in direction X to a position that exposes the notch 106 to the pin 102. The cylinder lock bracket 104 pivots under the force of the pin 102 on face 103 of the cylinder lock bracket as the cylinder lock 100 moves in direction X and latches onto the pin 102. After the cylinder lock 100 has latched onto the pin 102, the hydraulic cylinder 74 may be released and the weight of the container door 20 is supported by the pin 102 and the cylinder lock.

To disengage the cylinder lock 100, the hydraulic cylinder 74 is pressurized so that the cylinder rod 107 is further retracted to move the cylinder lock further in direction X. Moving the cylinder lock 100 further in direction X allows the notch 106 to disengage the pin 102. Once the pin 102 is removed from the notch 106, the cylinder lock bracket 104 is pivoted under the force of a torsion spring 110 to the closed position shown in FIG. 2. Once the cylinder lock bracket 104 has moved to the position shown in FIG. 2, the hydraulic cylinder 74 is allowed to extend. The cylinder lock 100 is guided over the pin 102 by the face 105 of the cylinder lock bracket 104 so that the pin 102 is not allowed access to the notch 106.

Returning to FIG. 1, the container door 20 of the vacuum system 10 and the door sealing system 23 will be discussed in more detail. The container door 20 comprises a gate valve assembly 112 and the container door sealing system 23. The gate valve assembly 112 is adapted to drain the liquid portion of materials vacuumed into the container 16, without requiring opening of the container door 20. The container door sealing system 23 is supported at a central location on the door 20 and adapted to engage the container door with the container 16 and to seal the container door to the container. The container door sealing system 23 engages a connecting rod 117 to latch the container door 20 to the container 16. The connecting rod 117 is fixed to the second end 52 of the container 16 and is generally elongate to run the length of the container 16.

Figure 3:
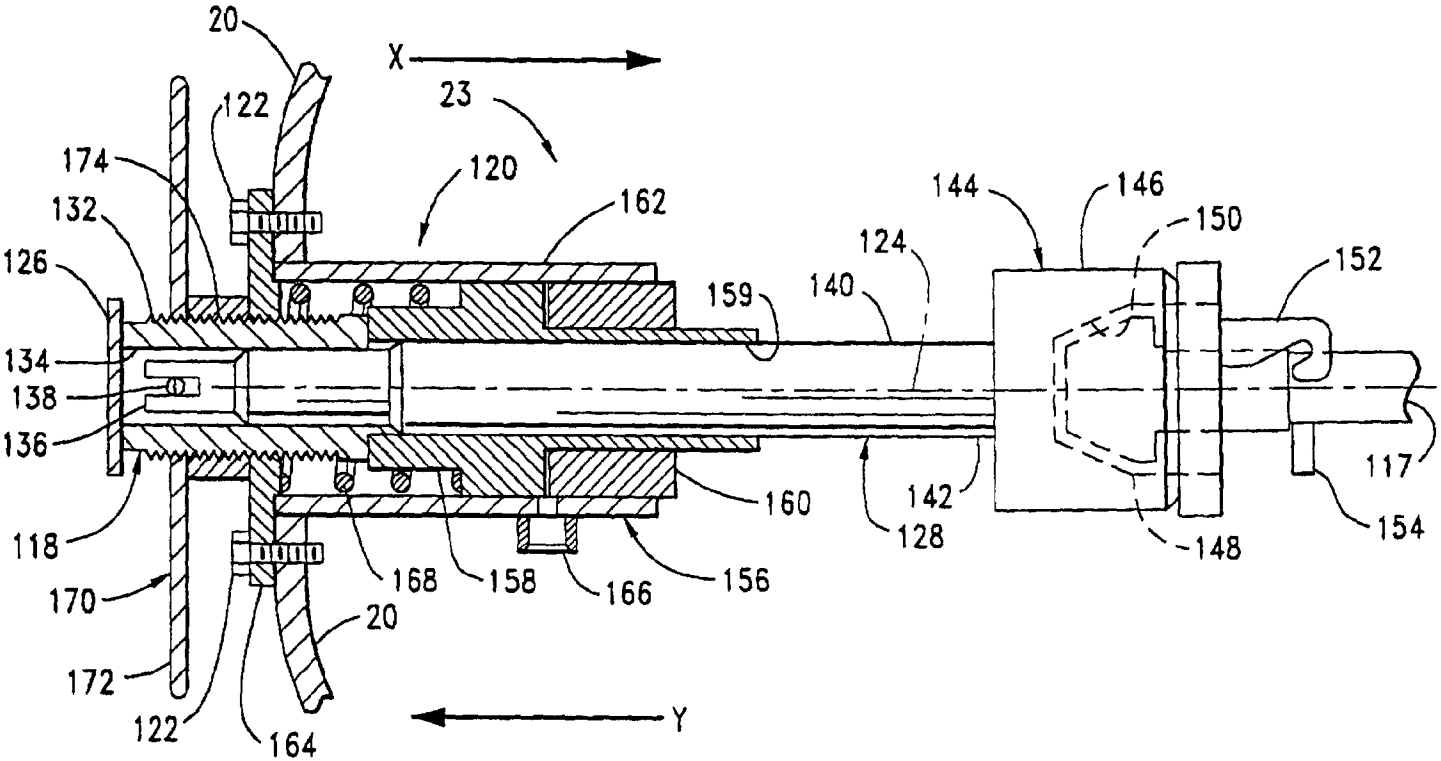
FIG. 3 is a partly sectional view of the door sealing system of FIG. 1. The door sealing system is shown having a latching assembly and a power operated sealing assembly.

Turning now to FIG. 3, the container door sealing system 23 and its interaction with the connecting rod 117 will be discussed with more detail. The container door sealing system 23 of FIG. 3 is adapted to hermetically seal the container door 20 with the container 16 from a single central location on the container door. The container door sealing system 23 is shown mounted to the container door 20 using bolts 122. The door sealing system 23 comprises a latch assembly 118 and a power operated pulling assembly 120 located within the container 16. The latch assembly 118 is adapted to engage the container door 20 with the container 16 along a load bearing axis 124. The power operated pulling assembly 120 is adapted to force the container door 20 against the container 16 by applying a load that is collinear with the load bearing axis 124 to seal the container door to the container. The load bearing axis 124 of the present embodiment is defined by the positioning of the connecting rod 117 and the latching assembly 118 and the longitudinal axes of both. It will be appreciated that the placement of the connecting rod 117 within the container 16 and the latch assembly 118 may be changed to alter the angle and orientation of the load bearing axis. It will be further appreciated that the latch assembly 118 and connecting rod 117 may be positioned so that neither is collinear with the central axis of the container 16.

Figure 4:
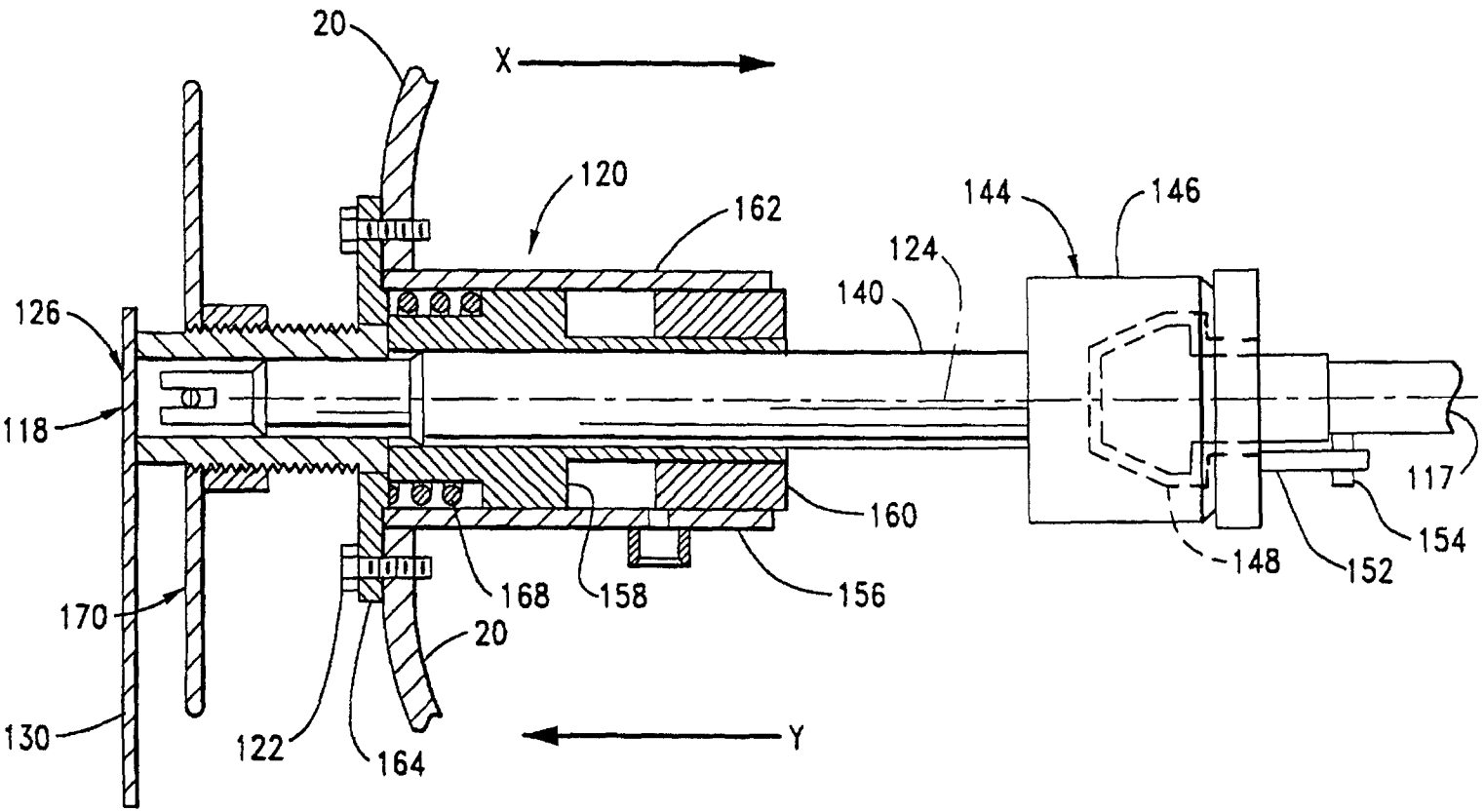
FIG. 4 is a partly sectional view of the door sealing system of FIG. 3 showing the latching assembly engaging the container door with the container.

The latch assembly 118 comprises an actuation handle 126 and a connecting shaft 128. The actuation handle 126 is constructed to form a single connection between the container door 20 and the container 16. The actuation handle 126 may comprise a handle 130 (FIGS. 4 & 5) and a body 132. The handle 130, as shown in FIG. 4, is generally elongate and allows the operator to manually rotate the actuation handle 126. The body 132 is generally cylindrical having a bore 134. The bore 134 is constructed to receive a front end 136 of the connecting shaft 128 to operatively connect the shaft to the actuation handle 126. The connecting shaft 128 is connected to the body 132 of the actuation handle 126 using a pin 138. This connection allows for torque transmission between the actuation handle 126 and the connection shaft 128 as well as synchronous linear movement of the handle and shaft in directions X and Y. While the present embodiment has been described with reference to a mechanically actuated latching device, it will be appreciated that a hydraulically or electrically actuated latching device may be employed.

The connecting shaft 128 is generally cylindrical and elongate having a body 140, the front end 136 and a rear end 142. The rear end 142 is configured to have at least one latch device 144 adapted to connect the container door 20 to the connecting road 117 of the container 16. The latch device 144 comprises a keyway cylinder 146 adapted to receive a key 148 when the body 140 of the connecting shaft 128 is slidably moved toward the container 16 and rotated. The key 148 is supported to the connecting rod 117 and configured for mating engagement with the keyway cylinder 146. The keyway cylinder 146 has an internal chamber 150 for receiving engagement with the key 148 and a latch hook 152 adapted to receive a latch pin 154 disposed on the connecting rod 117. The internal chamber 150 is formed so that when the cylinder 146 is rotated the key 148 cannot be withdrawn from the cylinder if movement of the connecting shaft 128 in direction Y is attempted.

After the container door 20 is latched to close the container 16, the power operated pulling assembly 120 may be activated to seal the container. The power operated pulling assembly 120 comprises a hydraulic cylinder 156 adapted to pull the container door 20 in direction X and against the rim 54 of the container 16 (FIG. 1). The hydraulic cylinder 156 forces the container door 20 against the container 16 by applying a load upon the door that is collinear with the load bearing axis 124 of the connecting shaft 128 and the connection rod 117 to seal the container door to the container 16. The hydraulic cylinder 156 comprises a piston 158 and a cylinder head 160, both disposed within a cylinder barrel 162. The cylinder barrel 162 may be constructed to form a flange 164 for supporting the hydraulic cylinder 156 within the container 16 using the bolts 122. It will, however, be appreciated that the hydraulic cylinder 156 could be supported at other locations within the container. For example, the hydraulic cylinder may be disposed within the second end 52 of the container 16 to pull the door 20 against the container 16.

The piston 158 is positioned within the barrel 162 between the cylinder head 160 and a compression spring 168. The piston 158 has a bore 159 through which the connecting shaft 128 passes. The piston 158 is adapted to abut the actuation handle body 132. Thus, when the cylinder 156 is pressurized and the piston 158 is moved in direction Y, the container door 20 is moved in direction X and the actuation handle 126 is moved in direction Y, relative to the container door. The compression spring 168 functions to return the piston 158 to the position shown in FIG. 3 when the fluid has been bled from the cylinder 156.

Hydraulic fluid (not shown) enters the cylinder barrel 162 through an inlet 166 and forces the cylinder head 160 in direction X. Movement of the cylinder head 160 in direction Y also pulls the body 140 of the connecting shaft 128 in direction Y. Thus, the result of having the keyway cylinder 146 and key 148 engaged plus the pulling action of the hydraulic cylinder 156 is to pull the container door 20 and the door sealing system 23 in direction X. Movement of the cylinder head 160 in direction X compresses the spring 168, and pushes the latch assembly 118 out from within the cylinder barrel 162.

After the container door 20 has moved in direction X, a locking assembly 170 may be used to lock the container door 20 to the container 16 (FIG. 1). The locking assembly 170 is disposed on the body 132 of the latch assembly 118 and adapted to lock the container door 20 to the container 16. Further, the locking assembly 170 may be adapted to maintain the container door 20 against the container 16 after the power operated pulling assembly 120 has forced the container door against the container. The locking assembly 170 of the present embodiment is constructed to have handles 172 and an internally threaded bore 174 adapted for threaded engagement with a threaded portion 175 of the actuation handle body 132. Thus, the locking assembly 170 comprises a mechanical lock-out device threadably connected to the latch assembly 118 and, configured to rotationally move in a clockwise and counterclockwise direction.

Continuing with FIG. 3, the latch assembly 118 is shown slidably moved toward the connecting rod 117 of the container 16 and the keyway cylinder 146 is mated with the key 148. However, the container door 20 is not latched to the connecting rod 117. At this stage, the container door 20 is closed and the keyway cylinder 146 has been moved onto the key 148 and the power operated pulling assembly 120 is in a first position.

Turning now to FIG. 4, the door sealing system 23 is shown in a configuration where the container door 20 has been forced against the container 16 by applying a load, as described above, that is collinear with the load bearing axis 124 to seal the container door 20 to the container 16. However, the locking assembly 170 has not been actuated to lock the container 16 and container door 20 in a sealed configuration after the power operated pulling assembly 120 is released. The connecting shaft 140 of FIG. 3 is shown moved toward the connecting rod 117 and manually rotated less than a full turn to permit the key way cylinder 146 to engage the key 148 of the latch assembly 118. Rotation of the actuation handle 126 causes the latch hook 152 to receive the latch pin 154 to form a positive stop. While the embodiment of FIGS. 3 and 4 uses a manually rotated latch assembly 118, it will be appreciated, that the connecting shaft 140 may be moved toward the connecting rod 117 and rotated either by a hydraulically actuated or an electrically actuated latching device.

After the latch assembly 118 has been moved in direction X and rotated so that the latch hook 152 has received the latch pin 154, the hydraulic cylinder 156 is pressured to force the container door 20 against the container 16 by pulling the container door in direction X. The effect of pressurizing the power operated pulling assembly 120 is illustrated in FIG. 4 by showing that the connecting shaft 140 and actuation handle 126 are protruding further from the flange 164, then as shown in FIG. 3. As further evidence of movement, the locking assembly 170 is no longer abutting the flange 164. Operation of the power operated pulling assembly 120 forces the container door 20 against the container rim 54 and the rubber seal disposed thereon to hermetically seal the container door with the container 16 from a single central location on the container door. While the power operated pulling assembly has been described with reference to a hydraulic cylinder 156, it will be appreciated that other devices and methods may be used to seal the container. For example, the container may be sealed using an electric motor adapted to operate a screw thread drive.

Figure 5:
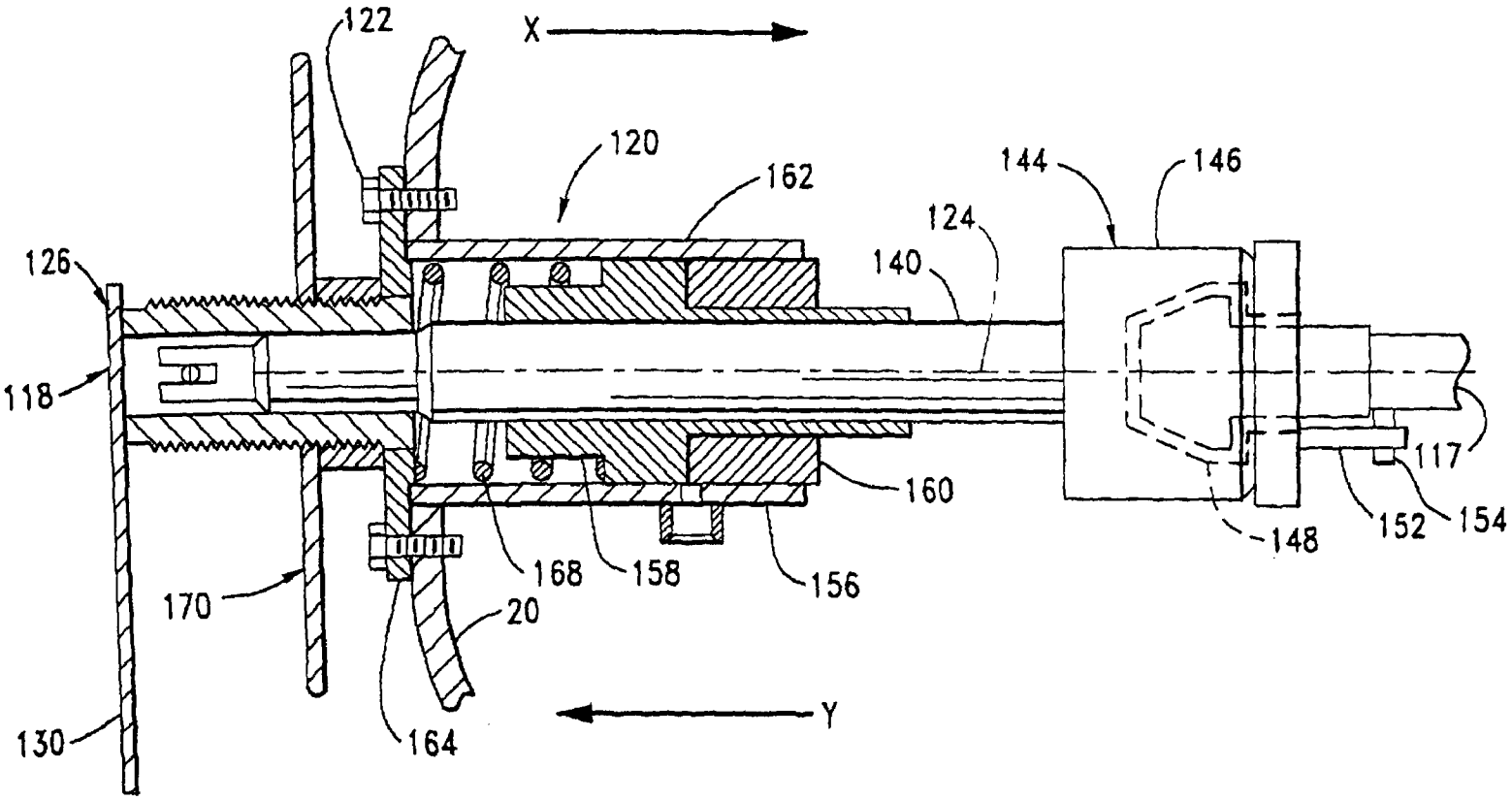
FIG. 5 is a partly sectional view of the door sealing system of FIGS. 3 and 4.

With reference now to FIG. 5, the locking assembly 170 is shown maintaining the container door 20 against the container 16 in a sealed configuration after the power operated pulling assembly 120 has forced the container door against the container. The locking assembly 170 has been rotationally threaded down the body 132 to a position abutting the flange 164 to lock the latch assembly 118 and connecting shaft 140 of the latch assembly in the position shown. It will be appreciated that after the locking assembly 170 has locked the latch assembly 118 in the position shown in FIG. 5, the force exerted upon the latch assembly 118 by the power operated pulling assembly 120 may be released and the hydraulic pressure bled from the hydraulic cylinder 156. Bleeding the hydraulic fluid from the cylinder 156 will allow the piston 158 to move to the position shown in FIG. 5 under the force of spring 168. Thus, the container door 20 is mechanically locked against the container 16 by the forces exerted on the latch assembly 118 and the locking assembly 170.

To unseal the container 16 and unlatch the container door 20, the hydraulic cylinder 156 may be re-pressurized so that the piston 158 is moved in direction Y until it abuts the actuation handle body 132. The force exerted on the body 132 by the piston 158 relieves the forces exerted upon the threaded connection so that the locking assembly may be rotated and moved away from the flange 164. After the locking assembly has been moved away from the flange 164 a sufficient distance, the hydraulic pressure exerted against the piston 158 may be released and the piston returned to the position shown in FIGS. 3 and 5. As the hydraulic pressure is released from the cylinder 156, the latch assembly 118 moves in direction X, relative to the container door, allowing the operator to rotate the latch assembly to disengage the latch hook 152 from latch pin 154 and remove the keyway cylinder 146 from the key 148.

The present invention also comprises a method for sealing the container door 20 of the container 16. The container door 20 is sealed to the container 16 by latching the container door to the container from inside the container and power sealing the container door to the container. The container door 20 is power sealed to the container 16 by applying a load to the container and the container door from within the container. In accordance with the present invention, the method may further comprise mechanically locking the container door 20 with the container 16 after power sealing the container door to the container. Mechanically locking the container door 20 may comprise maintaining the container door sealed with the container 16 after releasing the power seal.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A door sealing system for a container having a container door, the sealing system comprising:

a latch assembly on the container door to latch the container door with the container along a load bearing axis, the latch assembly comprising an actuation handle configured to form a single connection between the container and the container door, and a connecting shaft having a front end and a rear end, the front end being operatively connected to the actuation handle;

a power operated putting assembly located within the container and adapted to force the container door against the container by applying a load that is collinear with the load bearing axis to seal the container door to the container, wherein the connecting shaft is rotatable and slidably movable through the power operated pulling assembly in a direction toward and away from the container and the rear end is configured to have at least one latch device adapted to connect the door to the container.

2. The sealing system of claim 1 further comprising a locking assembly disposed on the latch assembly and adapted to lock the container door to the container.

3. The sealing system of claim 2 wherein the locking assembly maintains the container door against the container after the power operated pulling assembly has forced the container door against the container.

4. The sealing system of claim 1 further comprising at least one sealing surface disposed around an opening of the container and adapted to form a hermetic seal between the container and the container door in response to the power operated pulling assembly forcing the container door against the container.

5. The sealing system of claim 4 wherein the power operated pulling assembly is adapted to hermetically seal the container door with the container from a single central location on the container door.

6. The sealing system of claim 1 wherein the power operated pulling assembly is electrically driven.

7. The sealing system of claim 1 wherein the power operated pulling assembly comprises a hydraulic cylinder mechanism.

8. The sealing system of claim 1 wherein the power operated pulling assembly is supported by the container door at a central location.

9. The sealing system of claim 1 wherein the latch device comprises a keyway cylinder adapted to receive a key, supported by the container, when the body of the connecting shaft is slidably moved toward the container and rotated.

10. The sealing system of claim 9 wherein the key comprises a latch pin and the keyway cylinder comprises a latch hook adapted to receive the latch pin when the connecting shaft is moved toward the container and rotated.

11. The sealing system of claim 10 wherein the interaction of the latch hook with the latch pin forms a positive stop when the connecting shaft is rotated.

12. The sealing system of claim 9 wherein in the at least one keyway cylinder is disengaged from the at least one key in response to rotation and axial movement of the connecting shaft of the latch assembly away from the container.

13. The sealing system of claim 9 wherein the actuation handle of the latch assembly is rotated less than a full turn to permit the at least one keyway cylinder to engage the at least one key of the latch assembly.

14. The sealing system of claim 1 wherein the latch assembly comprises a mechanical lock-out device.

15. The sealing system of claim 14 wherein the mechanical lock-out device comprises a lock-out handle threadably connected onto the latch assembly and configured to rotationally move in a clockwise and counterclockwise direction.

16. The sealing system of claim 14 wherein the mechanical lock-out device is adapted to operate in a locked configuration in which the container door is secured to the container after the power operated pulling assembly has forced the container door against the container.

17. The sealing system of claim 16 wherein the mechanical lock-out device is adapted to maintain the container door against the container after the power operated pulling assembly has forced the container door against the container.

18. The sealing system of claim 1 wherein the latch assembly comprises a hydraulically actuated latching device.

19. The sealing system of claim 1 wherein the latch assembly comprises an electrically actuated latching device.

20. A vacuum system comprising:

a frame; and a container having a container door supported on the frame; and a container door sealing system, the door sealing system comprising:

a latch assembly on the container door and adapted to latch the container door with the container along a load bearing axis, the latch assembly comprising:

an actuation handle configured to form a single connection between the container and the container door; and a connecting shaft having a front end and a rear end, the front end being operatively connected to the actuating handle; and a power operated pulling assembly located within the container and adapted to force the container door against the container by applying a load that is collinear with the load bearing axis to seal the container door to the container;

wherein the connecting shaft is rotatable and slidably movable through the power operated pulling assembly in a direction toward and away from the container and the rear end is configured to have at least one latch device adapted to connect the door to the container.

21. The vacuum system of claim 20 further comprising a locking assembly disposed on the latch assembly and adapted to lock the container door to the container.

22. The vacuum system of claim 21 wherein the locking assembly maintains the container door against the container after the power operated pulling assembly has forced the container door against the container.

23. The vacuum system of claim 20 further comprising at least one sealing surface disposed around an opening of the container and adapted to form a hermetic seal between the container and the container door in response to the power operated pulling assembly forcing the container door against the container.

24. The vacuum system of claim 23 wherein the power operated pulling assembly is adapted to hermetically seal the container door with the container from a single central location on the container door.

25. The vacuum system of claim 20 wherein the power operated pulling assembly is electrically driven.

26. The vacuum system of claim 20 wherein the power operated pulling assembly comprises a hydraulic cylinder mechanism.

27. The vacuum system of claim 20 wherein the power operated pulling assembly is supported by the container door at a central location.

28. The vacuum system of claim 20 wherein the latch device comprises a keyway cylinder adapted to receive a key, supported by the container, when the body of the connecting shaft is slidably moved toward the container and rotated.

29. The vacuum system of claim 28 wherein the key comprises a latch pin and the keyway cylinder comprises a latch hook adapted to receive the latch pin when the connecting shaft is moved toward the container and rotated.

30. The vacuum system of claim 29 wherein the interaction of the latch hook with the latch pin forms a positive stop when the connecting shaft is rotated.

31. The vacuum system of claim 28 wherein in the at least one keyway cylinder is disengaged from the at least one key in response to rotation and axial movement of the connecting shaft of the latch assembly away from the container.

32. The vacuum system of claim 28 wherein the actuation handle of the latch assembly is rotated less than a full turn to permit the at least one keyway cylinder to engage the at least one key of the latch assembly.

33. The vacuum system of claim 20 wherein the latch assembly comprises a mechanical lock-out device.

34. The vacuum system of claim 33 wherein the mechanical lock-out device comprises a lock-out handle threadably connected onto the latch assembly and configured to rotationally move in a clockwise and counterclockwise direction.

35. The vacuum system of claim 33 wherein the mechanical lock-out device is adapted to operate in a locked configuration in which the container door is secured to the container after the power operated pulling assembly has forced the container door against the container.

36. The vacuum system of claim 35 wherein the mechanical lock-out device is adapted to maintain the container door against the container after the power operated pulling assembly has forced the container door against the container.

37. The vacuum system of claim 20 wherein the latch assembly comprises a mechanical latching device.

38. The vacuum system of claim 20 wherein the latch assembly comprises a hydraulically actuated latching device.

39. The vacuum system of claim 20 wherein the latch assembly comprises an electrically actuated latching device.

* * * * *

UNITED STATES PATENT AND TRADEMARK OFFICE

CERTIFICATE OF CORRECTION

PATENT NO. : 8,066,140 B1
APPLICATION NO. : 10/377411
DATED : November 29, 2011
INVENTOR(S) : Young et al.

It is certified that error appears in the above-identified patent and that said Letters Patent is hereby corrected as shown below:

Column 8, line 45, please delete “putting” and substitute therefore --pulling--.

Signed and Sealed this
Tenth Day of January, 2012

David J. Kappos

David J. Kappos
*Director of the United States Patent and Trademark Office*